US010058226B2

(12) United States Patent
Spång et al.

(10) Patent No.: US 10,058,226 B2
(45) Date of Patent: Aug. 28, 2018

(54) DISHWASHER COMPRISING AT LEAST ONE DISHWASHER SPRAY ARM

(71) Applicant: ELECTROLUX APPLIANCES AKTIEBOLAG, Stockholm (SE)

(72) Inventors: Johan Spång, Stockholm (SE); Finn Svensson, Stockholm (SE); Elianne Lindmark, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 16 days.

(21) Appl. No.: 15/116,109

(22) PCT Filed: Mar. 24, 2014

(86) PCT No.: PCT/EP2014/055842
§ 371 (c)(1),
(2) Date: Aug. 2, 2016

(87) PCT Pub. No.: WO2015/144198
PCT Pub. Date: Oct. 1, 2015

(65) Prior Publication Data

US 2017/0135549 A1 May 18, 2017

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)

(58) Field of Classification Search
CPC ..... A47L 15/23; A47L 15/4282
See application file for complete search history.

(56) References Cited

U.S. PATENT DOCUMENTS 2,956,572 A * 10/1960 Levit ..... A47L 15/23 134/176
3,268,176 A * 8/1966 O'Brien ..... B05B 1/042 239/536
4,210,285 A 7/1980 Dicken, Jr. et al.
4,509,687 A 4/1985 Cushing
5,074,322 A 12/1991 Jaw
(Continued)

FOREIGN PATENT DOCUMENTS

DE 44 16 655 11/1995
DE 19736919 3/1999
(Continued)

OTHER PUBLICATIONS

Extended European Search Report for corresponding European Application No. 10005406.3 dated Nov. 18, 2010, 7 pages.
(Continued)

*Primary Examiner* — Michael Barr
*Assistant Examiner* — Benjamin L Osterhout
(74) *Attorney, Agent, or Firm* — Alston & Bird LLP

(57) ABSTRACT

A dishwasher with a dishwasher spray arm is provided. The dishwasher spray arm may include a washing liquid intake, an inner volume, and at least one opening arranged to dispense washing liquid from the inner volume to a washing chamber. The dishwasher spray arm may also include one or more guide vanes in a vicinity of the at least one opening. The one or more guide vanes may at least partly prevent a rotating movement of washing liquid dispensed via the at least one opening.

13 Claims, 4 Drawing Sheets

(56) References Cited

U.S. PATENT DOCUMENTS

| | | | | |
|---|---|---|---|---|
| 5,165,435 | A | 11/1992 | Thies et al. | |
| 5,598,976 | A | 2/1997 | Jang et al. | |
| 5,972,126 | A | 10/1999 | Fernie | |
| 6,263,888 | B1 | 7/2001 | Nomura et al. | |
| 7,810,512 | B2 | 10/2010 | Pyo et al. | |
| 8,020,568 | B2 | 9/2011 | Pyo et al. | |
| 2005/0150529 | A1* | 7/2005 | Vanderroest | A47L 15/16 134/135 |
| 2005/0166945 | A1 | 8/2005 | Whitmore | |
| 2008/0135065 | A1 | 6/2008 | Yao et al. | |
| 2008/0276975 | A1 | 11/2008 | Disch et al. | |
| 2009/0255560 | A1 | 10/2009 | Lehmann et al. | |
| 2010/0108102 | A1* | 5/2010 | Kehl | A47L 15/23 134/25.2 |
| 2010/0224223 | A1 | 9/2010 | Kehl et al. | |
| 2011/0203619 | A1 | 8/2011 | Kara et al. | |
| 2012/0325277 | A1 | 12/2012 | Mitchell et al. | |
| 2013/0284216 | A1* | 10/2013 | Forster | A47L 15/23 134/179 |

FOREIGN PATENT DOCUMENTS

| | | |
|---|---|---|
| DE | 10 2011 088494 | 6/2013 |
| DE | 102012103445 | 10/2013 |
| EP | 0 469 184 | 2/1992 |
| EP | 0 988 824 | 3/2000 |
| EP | 1 510 168 | 3/2005 |
| EP | 1 634 526 | 3/2006 |
| EP | 2 110 063 | 10/2009 |
| EP | 2 449 945 | 5/2012 |
| FR | 2 505 643 | 11/1982 |
| JP | H04 279138 | 10/1992 |
| WO | WO 2009/021626 | 2/2009 |
| WO | WO 2011/144540 | 11/2011 |

OTHER PUBLICATIONS

International Search Report and Written Opinion for Application No. PCT/EP2011/057970, dated Oct. 31, 2011.

International Search Report for Application No. PCT/EP2014/055842, dated Dec. 9, 2014.

Office Action for corresponding U.S. Appl. No. 13/699,440 dated Apr. 10, 2014.

Notice of Allowance for corresponding U.S. Appl. No. 13/699,440 dated Nov. 7, 2014.

Office Action for corresponding Russian Patent Application No. 2016131910/20(049523), dated Sep. 21, 2016, with English translation, 3 pages.

Written Opinion for corresponding International Patent Application No. PCT/EP2014/055842 dated Sep. 24, 2016, 9 pages.

Office Action for corresponding Russian Patent Application No. 2016131910/12(049523), dated Nov. 23, 2017, with English summary, 9 pages.

* cited by examiner

DISHWASHER COMPRISING AT LEAST ONE DISHWASHER SPRAY ARM

CROSS-REFERENCE TO RELATED APPLICATIONS

This application is a national stage application filed under 35 U.S.C. § 371 of International Application No. PCT/EP2014/055842 filed Mar. 24, 2014, which application is hereby incorporated by reference in its entirety.

TECHNICAL FIELD

Embodiments herein relate to a dishwasher comprising at least one dishwasher spray arm.

BACKGROUND

A dishwasher, such as a domestic dishwasher, normally comprises a washing chamber. One or two racks are often arranged within the washing chamber, and a user may arrange glasses, plates, cutlery etc. on the racks.

During a washing cycle, washing liquid is dispensed onto the dish inside the washing chamber. The washing liquid may be dispensed via openings in one or more spray arms. The spray arms are often arranged horizontally above and/or below the racks for the dish. The spray arms are sometimes rotatably arranged inside the washing chamber, and they may be forced to rotate when the washing liquid is dispensed. The rotation may be caused by the pressure of the washing liquid. Since the spray arms rotate, washing liquid dispensed as one or more jets via the holes in the spray arms may reach dish in all parts of the racks.

When the washing liquid has been dispensed into the washing chamber, it is typically collected in a sump or similar in the bottom of the washing chamber. In some washing cycles, the washing liquid is recirculated back to the spray arms via a dishwasher circulation circuit. The washing liquid may then be dispensed as jets onto the dish via the spray arms again.

In US20110203619A1, a dishwasher spray arm is illustrated. The spray arm comprises nozzles on one side of the spray arm. On an opposite side of the spray arm flow obstacles are arranged. The flow obstacles are arranged to cause certain geometry of the dispensed jet. Several different geometries are discussed.

The arrangement according to US20110203619A1 may be useful in some applications. However, it may still be desirable to improve the cleaning and/or rinsing effect of the one or more jets. The flow obstacle arrangement according to US20110203619A1 may be difficult to manufacture, and in addition, debris in the washing liquid may get caught between a nozzle and an oppositely arranged flow obstacle Improvements related to dishwashers, dishwasher spray arms and/or jets dispensed from dishwasher spray arms are therefore desirable.

SUMMARY

Embodiments herein aim to provide a dishwasher comprising a washing chamber and at least one spray arm, eliminating or at least reducing the problems and/or drawbacks associated with prior art solutions.

According to an embodiment, this is provided by a dishwasher comprising a washing chamber and at least one dishwasher spray arm, the at least one dishwasher spray arm comprising a washing liquid intake, an inner volume, at least one opening arranged to dispense washing liquid from the inner volume to the washing chamber, wherein the dishwasher spray arm comprises one or more guide vanes in a vicinity of the at least one opening in a flow channel defined by the inner volume, the one or more guide vanes being arranged to at least partly prevent a rotating movement of washing liquid dispensed via the at least one opening.

Since the dishwasher spray arm comprises one or more guide vanes in a vicinity of the at least one opening, the one or more guide vanes being arranged to at least partly prevent a rotating movement of washing liquid dispensed via the at least one opening, the washing liquid is guided towards the at least one opening with a less rotating movement.

The dishwasher spray arm is often arranged to rotate around an axis which is substantially parallel to a centre axis of an opening which forms the washing liquid intake. The washing liquid inside the inner volume of the dishwasher spray arm is rotating together with the dishwasher spray arm with an overall rotating movement.

In addition to this overall rotating movement, the washing liquid sometimes rotates with a rotating movement within the inner volume. This rotating movement may at least partly be caused by the overall rotating movement of the dishwasher spray arm. When the washing liquid flows from the washing liquid intake towards the one or more openings in the dishwasher spray arm, the washing liquid thus may start to rotate around an opening through which the washing liquid is about to be dispensed. This rotating movement of the washing liquid around the one or more openings inside the inner volume may cause the washing liquid jet which is dispensed via the one or more opening to break up when dispensed through the one or more opening.

In some applications this breakup of the washing liquid jet is undesirable, since a jet which is coherent until it reaches dish arranged in the washing chamber may remove dirt from the dish in a more efficient manner. Since the dishwasher spray arm comprises one or more guide vanes in the vicinity of the at least one opening, the rotating movement which causes the breakup of the jet is, at least partly, prevented. The one or more guide vanes are thus configured to reduce the inherent inertia of the washing liquid imparted to the washing liquid by the rotating dishwasher spray arm.

Thus, hereby is provided a dishwasher which significantly improves the cleaning and/or rinsing effect of a washing liquid jet dispensed via the dishwasher spray arm of the dishwasher. As a result, the above mentioned object is achieved.

According to some embodiments, the one or more guide vanes extend in a substantially radial direction from the at least one opening.

Since the one or more guide vanes extend in a substantially radial direction from the at least one opening, the washing liquid that approaches the opening will approach the at least one opening with a less rotating movement around a center axis of the one or more opening. The guide vanes will cause at least some of the washing liquid inside the inner volume which is about to be dispensed to flow against the opening with a significantly reduced amount of rotation around the opening. The dispensed washing liquid will therefore rotate less when being dispensed through the one or more openings. This will cause the washing liquid jet to propelled substantially as a coherent washing liquid jet, and the washing and rinsing effect when the washing liquid jet reaches dirt on dish arranged on the dish racks is greatly improved.

According to some embodiments, two or more guide vanes extend in a substantially radial direction from the at least one opening.

Since two or more guide vanes extend in a substantially radial direction from the at least one opening washing liquid that approaches the at least one opening will, in the main extension plane of the dishwasher spray arm, approach the at least one opening with a larger angle than if no guide vanes had directed the washing liquid towards the at least one opening. Thus, the substantially radially directed guide vanes will guide at least some of the washing liquid to approach the opening in a substantially radial direction, i.e. 90 degrees, in the main extension plane of the dishwasher spray arm. Hereby the washing liquid jet is prevented from breaking up.

According to some embodiments, 3-6 guide vanes extend in a substantially radial direction from the at least one opening.

Since 3-6 guide vanes extend in a substantially radial direction from the at least one opening, a larger amount of the washing liquid which flows towards the at least one opening will flow towards the at least one opening with less rotation.

According to some embodiments, the at least one opening is arranged on a first side of the dishwasher spray arm and the one or more guide vanes are arranged on an inner surface portion of the first side of the dishwasher spray arm.

Since the at least one opening is arranged on a first side of the spray arm and the one or more guide vanes are arranged on an inner surface portion of the first side of the spray arm, the rotating movement of the washing liquid which is about to be dispensed is significantly reduced.

According to some embodiments, the at least one opening is shaped as a nozzle.

Since the at least one opening is shaped as a nozzle, the coherency of the washing liquid jet is further improved, and the washing and rinsing effect when the washing liquid jet reaches dish arranged on the dish racks is greatly improved.

According to some embodiments, the at least one nozzle comprises a nozzle inlet portion and a nozzle outlet portion.

Since the at least one nozzle comprises a nozzle inlet portion and a nozzle outlet portion, the characteristics/geometry of the washing liquid jet may be advantageous. The nozzle inlet portion may guide the washing liquid towards the nozzle outlet portion. The nozzle outlet portion may comprise a length in a direction away from a main extension plane of the dishwasher arm. The nozzle outlet portion may have e.g. a cylindrical shape, an elliptical shape, a frusto-conical shape or a rectangular shape, and is arranged to dispense the washing liquid when the washing liquid leaves the inner volume of the dishwasher arm.

According to some embodiments, the nozzle inlet portion is arranged with an angle with respect to a main extension plane of the dishwasher spray arm.

Since the nozzle inlet portion is arranged with an angle with respect to a main extension plane of the dishwasher spray arm, the washing liquid can be dispensed in different directions. In an embodiment the just mentioned angle can be from 10-90 degrees with respect to the main extension plane of the dishwasher spray arm.

According to some embodiments, the at least one opening has a diameter of least 3.5 millimeters.

Since the at least one opening has a diameter of least 3.5 millimeters, a relatively large washing liquid jet may be dispensed from the dishwasher spray arm. The one or more guide vanes will allow such a large jet to be coherent. The combination of a large-diameter opening and guide vanes on the inside of the opening is very efficient for removing dirt on dish arranged in the washing chamber.

According to some embodiments, the dishwasher spray arm is arranged to rotate when washing liquid is dispensed via the at least one opening.

Since the dishwasher spray arm is arranged to rotate when washing liquid is dispensed via the at least one opening the washing liquid that is dispensed via the at least one opening may reach substantially the entire washing chamber. Hereby dish arranged in the washing chamber is washed efficiently.

Further features of, and advantages with, the embodiments herein will become apparent when studying the appended claims and the following detailed description.

BRIEF DESCRIPTION OF THE DRAWINGS

The various aspects of non-limiting embodiments herein, including its particular features and advantages, will be readily understood from the following detailed description and the accompanying drawings, in which.

DETAILED DESCRIPTION

Embodiments herein will now be described more fully with reference to the accompanying drawings, in which non-limiting embodiments are shown. However, this application should not be construed as being limited to the embodiments set forth herein. Disclosed features of embodiments may be combined. Like numbers refer to like elements throughout the description.

Figure 1:
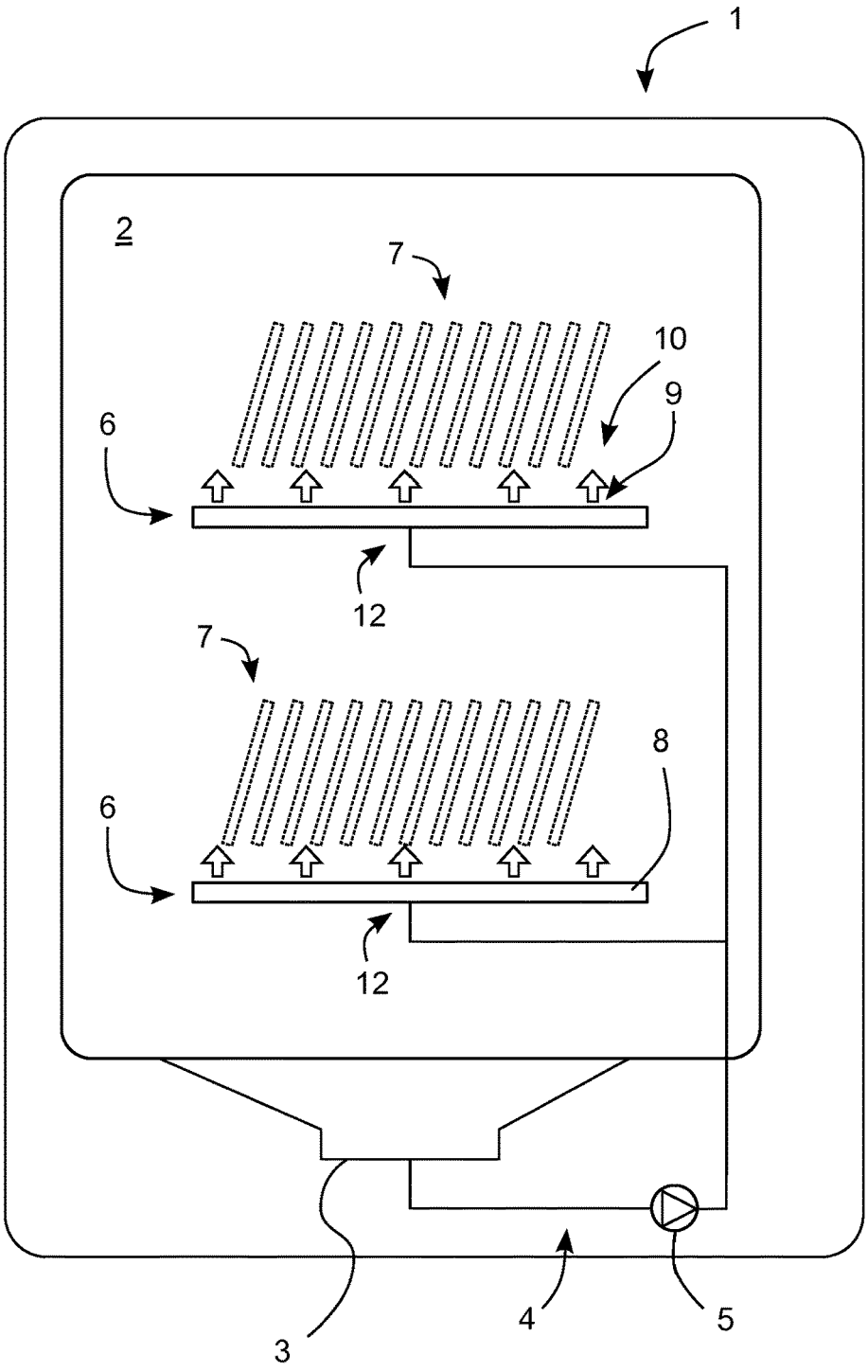
FIG. 1 illustrates a dishwasher and dishwasher spray arms according to some embodiments.

In FIG. 1 a dishwasher 1 is illustrated. The dishwasher 1 comprises a washing chamber 2 with a sump 3 and a circulation circuit 4. A circulation pump 5 is arranged to pump washing liquid in the circulation circuit 4 during at least parts of a washing cycle.

The dishwasher 1 also comprises at least one dishwasher spray arm 6 which is arranged to spray washing liquid into the washing chamber 2. In FIG. 1 an upper spray arm 6 and a lower spray arm 6 are illustrated. According to some embodiments, the lower spray arm 6 is arranged such that dish 7 arranged on a lower rack may be washed and/or rinsed, while the upper spray arm 6 may be arranged such that dish 7 arranged on an upper rack may be washed and/or rinsed.

The at least one spray arm 6 is part of the circulation circuit 4. Washing liquid pumped in the circulation circuit 4 from the circulation pump 5 may flow into the at least one spray arm 6 via conduits and a washing liquid intake 12 in the spray arm 6.

The washing liquid pumped into the spray arm 6 will flow into an inner volume 8 of the spray arm 6. The inner volume 8 is defined by inner surfaces of the dishwasher spray arm walls. When the circulation pump 5 is activated, a pressure is built up in the inner volume 8.

The dishwasher spray arm 6 comprises at least one opening 9. According to some embodiments the dishwasher spray arm comprises a plurality of openings 9, such as two, three or four openings 9. When the inner volume 8 is substantially filled with washing liquid, the washing liquid is forced to be dispensed in at least one washing liquid jet 10 out from the inner volume 8 into the washing chamber 2 via the at least one opening 9. A flow channel for the washing liquid is defined by the inner volume 8. Normally, the dishwasher spray arm 6 rotates and dispenses washing liquid simultaneously during one or several wash/rinse-cycles. Rotation of the dishwasher spray arm 6 may be caused e.g. by dispensing the washing liquid jet 10 in a certain angle relatively the main extension plane/attachment plane of the dishwasher spray arm 6.

Figure 2A:
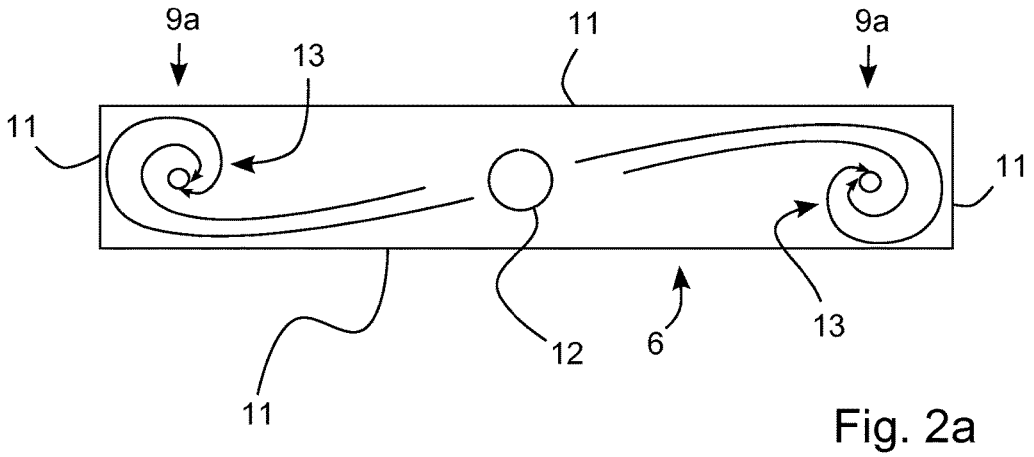
FIG. 2*a* illustrates a dishwasher spray arm according to the prior art.

In FIG. 2*a*, a dishwasher spray arm 6 according to the prior art is illustrated from above, i.e. in a direction substantially perpendicular to a main extension plane of the dishwasher spray arm 6. The dishwasher spray arm 6 comprises walls 11. The walls 11 of the dishwasher spray arm 6 form the inner volume 8. An upper wall 11 is removed in FIG. 2*a* such that the inner volume 8 is revealed in the figure.

The illustrated dishwasher spray arm 6 is elongated. A central portion of the dishwasher spray arm 6 may be rotatably attached to a surface or attachment part of the dishwasher and the washing liquid intake 12 may be fed with washing liquid. Two openings 9*a* are illustrated. When the dishwasher spray arm 6 is rotated and washing liquid flows from the washing liquid intake 12 to the openings 9*a*, the washing liquid sometimes start to flow in a rotating movement illustrated in FIG. 2*a* with the arrow 13 when the washing liquid approaches the openings 9*a*. The rotating movement may be caused e.g. by the overall rotation of the dishwasher spray arm 6 and/or the geometry of the dishwasher spray arm 6. As mentioned above, the rotating movement 13 may cause a washing liquid jet which is dispensed via the opening 9*a* to break up, i.e. to be dispensed in a non-coherent manner.

Figure 2B:
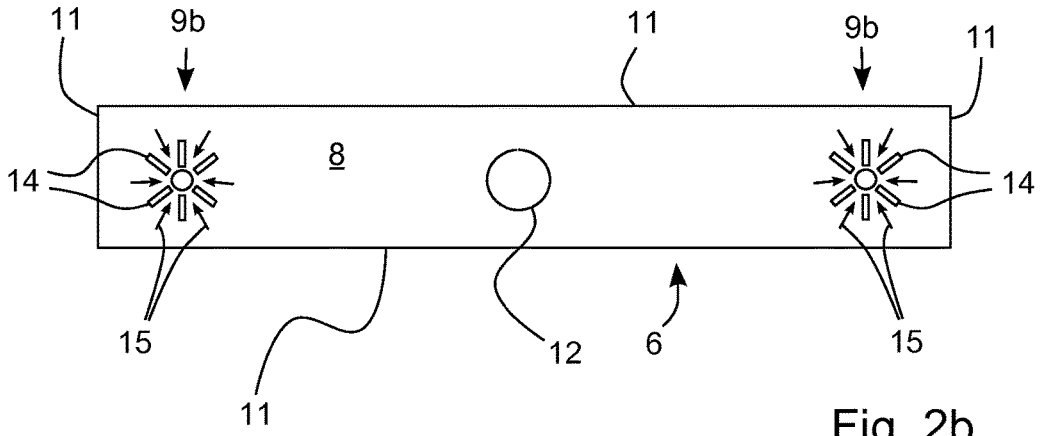
FIG. 2*b* illustrates a dishwasher spray arm according to some embodiments.

In FIG. 2*b* a dishwasher spray arm 6 according to embodiments described herein is illustrated. The dishwasher spray arm 6 resembles the dishwasher spray arm 6 illustrated in FIG. 2*a*, but in the vicinity of the openings 9*b*, one or more guide vanes 14 are arranged. The guide vanes 14 are arranged to at least partly prevent the rotating movement of the washing liquid when the washing liquid flows from the washing liquid intake 12 to the openings 9*b* via the flow channel defined by the inner volume 8. The at least partly prevented rotating movement is illustrated with the flow pattern 15. Some circulation in the flow pattern 15 may still occur, but to a less extent compared to the rotating movement. In some embodiments, the rotating movement is reduced or entirely prevented.

According to the embodiment illustrated in FIG. 2*b*, the one or more guide vanes 14 extend in a substantially radial direction from the at least one opening 9*b*. As illustrated with the flow pattern 15 arrows, the one or more guide vanes 14 guide the washing liquid substantially radially towards the openings 9*b*.

In some embodiments, the one or more guide vanes 14 extend in a non-radial direction from the openings 9*b*. The one or more guide vanes 14 may then be arranged with an angle relatively a center of the opening 9*b*. The angle may be e.g. 60-120 degrees.

The one or more guide vanes 14 may have any shape suitable for at least partly preventing the rotating movement of the washing liquid, illustrated by the arrow 13 in FIG. 2*a*. The one or more guide vanes 14 may be shaped as one or more vanes, blades, dimples and/or protrusions. The one or more guide vanes 14 may be attached to an inner surface of a wall 11 or to any separate attachment arrangement. The one or more guide vanes 14 may be attached permanently, such that very rigid guide vanes 14 are achieved, or temporarily attached which may facilitate removal of debris. The one or more guide vanes 14 may extent between two opposite walls 11, such as an upper and a lower wall, or may extent a predefined distance out from an inner surface of a wall 11. The one or more guide vanes 14 may be perpendicular or angled relatively a wall 11. According to some embodiments, the one or more guide vanes 14 may be formed as portions of a wall 11 of the dishwasher spray arm 6.

Figure 3A:
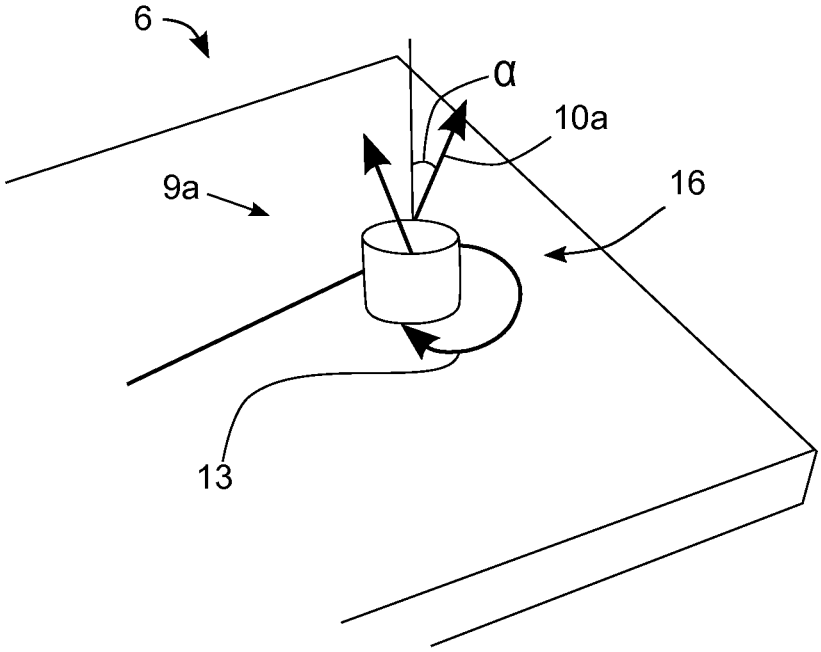
FIG. 3*a* illustrates a perspective view of a dishwasher spray arm according to the prior art.

In FIG. 3*a*, an end portion of a dishwasher spray arm 6 according to the prior art is illustrated. An opening 9*a* is shaped as a nozzle 16.

A nozzle 16 is an opening of the dishwasher spray arm 6 which is shaped as an exit tube/pipe for the washing liquid. The nozzle 16 may have a varying cross sectional area. The nozzle 16 may be configured to control direction, flow rate and/or flow characteristic of the washing fluid when the washing fluid is dispensed via the nozzle 16.

When the washing liquid flows towards the opening 9*a*, the rotating movement of the washing liquid flow occurs. This is illustrated with arrow 13. Due to this rotating movement, the washing liquid continues to rotate when it is dispensed via the nozzle 16. This is illustrated with washing liquid jet 10*a*. The direction of the washing liquid jet 10*a* may have an angle $\alpha$ relatively a nozzle direction. The dispensed washing liquid rotates around a centre of the nozzle and the rotating movement may be largest in peripheral parts of the nozzle 16. Sometimes the washing liquid jet 10*a* may be coherent a short distance after the washing liquid jet 10*a* has been dispensed from the opening 9*a*, e.g. due to surface tension. The washing liquid jet 10*a* may then break up a few centimeters away from the opening 9*a*.

A washing liquid jet 10 may be seen as non-coherent when the washing liquid jet 10*a* is dispersed. In this case, different portions of the washing liquid that forms the washing liquid jet 10*a* exit the opening 9*a* in different directions.

A washing liquid jet 10 may be seen as kept together, i.e. coherent, when a major part of the dispensed washing liquid has substantially the same direction when the washing liquid jet 10 exits an opening. The washing liquid jet 10 may then be fully dispersed first when the washing liquid jet 10 meets an obstacle of any kind, such as a plate or a glass within the washing chamber 2.

Figure 3B:
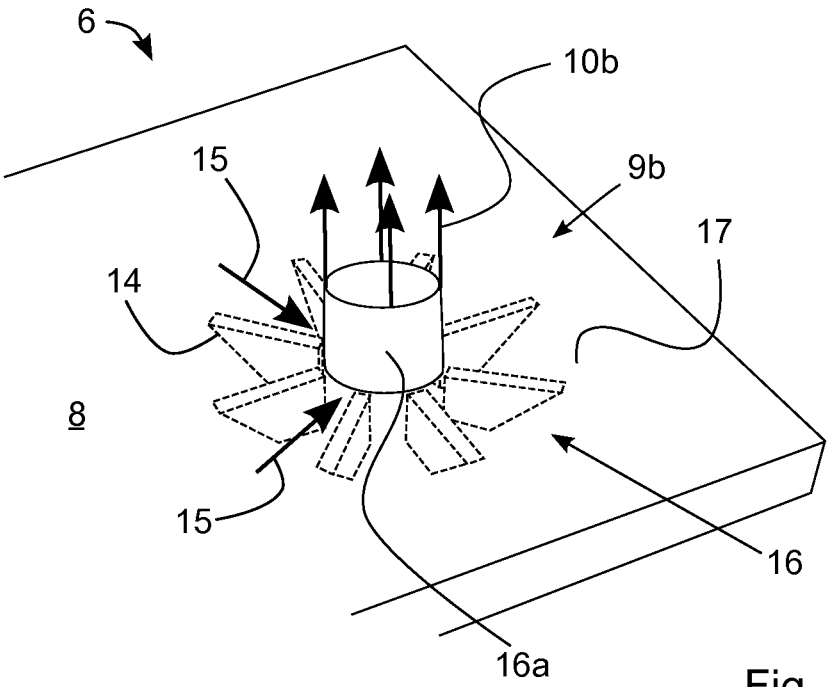
FIG. 3*b* illustrates a perspective view of a dishwasher spray arm according to some further embodiments.

In FIG. 3*b* a dishwasher spray arm 6 according to embodiments described herein is illustrated. The dishwasher spray arm 6 resembles the dishwasher spray arm 6 illustrated in FIG. 3*a*, but in the FIG. 3*b* embodiment guide vanes 14 are arranged around the opening 9*b*. The guide vanes 14 are arranged in the inner volume 8 of the dishwasher spray arm 6. In the FIG. 3*b* embodiment the opening 9*b* is shaped as a nozzle 16. Only one nozzle 16 is illustrated in FIG. 3*b*, but according some embodiments the dishwasher spray arm 6 comprises a plurality of nozzle 16.

In the vicinity of the opening 9*b*, guide vanes 14 are arranged. In the FIG. 3*b* embodiment, the guide vanes 14 are arranged on a first side 17 of the dishwasher spray arm 6, but according to other embodiments the guide vanes 14 may be arranged on any other sides or arranged on a nozzle outlet portion 16*a*. The guide vanes 14 at least partly prevent rotational movement of the washing liquid around the nozzle 16. The guided flow pattern is illustrated with arrows 15. Since the rotating movement of the washing liquid is at least partly prevented, the washing liquid jet 10*b* is coherent after being dispensed via the opening 9*b*.

In FIG. 3*b* eight guide vanes 14 are illustrated. With a high amount of guide vanes 14 any rotating movement of the washing liquid may be efficiently prevented or significantly reduced. Fewer guide vanes may reduce a risk that debris gets stuck near the opening 9.

Figure 4:
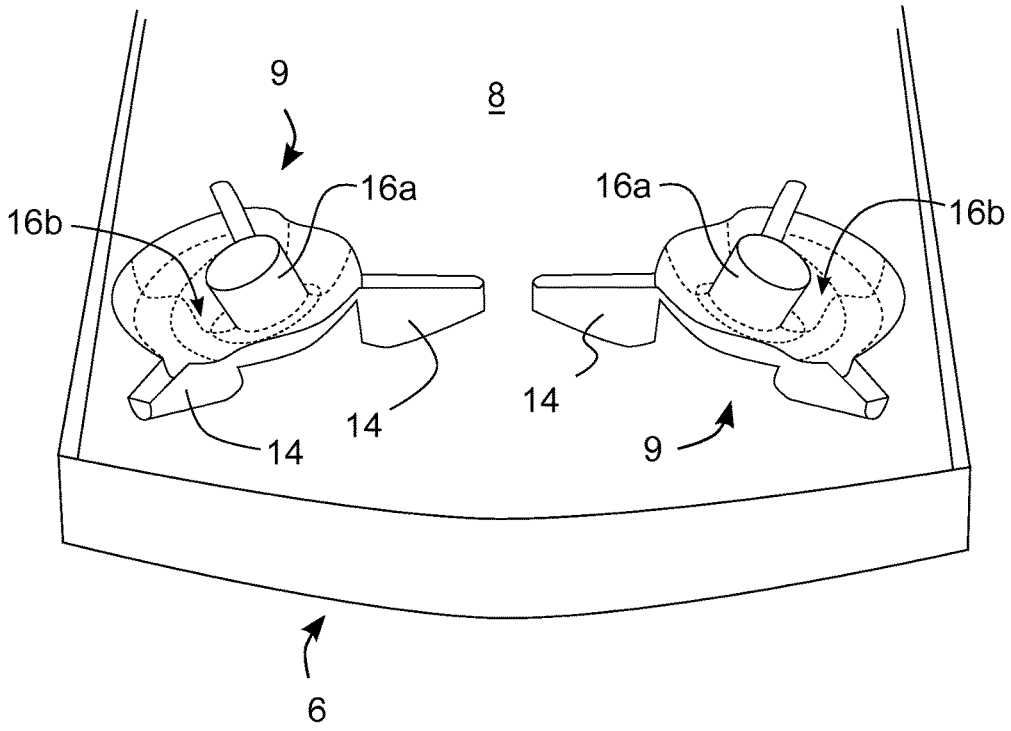
FIG. 4 illustrates a dishwasher spray arm according to yet some embodiments.

In FIG. 4 a portion of a dishwasher spray arm 6 according to an embodiment is illustrated. An upper wall of the dishwasher spray arm 6 is not illustrated in the figure, such that guide vanes 14, which otherwise may be arranged on an inside of the removed wall, are revealed.

The illustrated portion of the dishwasher spray arm 6 comprises two openings 9. The openings 9 are shaped as nozzles. Each nozzle comprises a nozzle outlet portion 16*a* and a nozzle inlet portion 16*b*. In the FIG. 4 embodiment each opening 9 is provided with three guide vanes 14. The guide vanes 14 may be integrated with the nozzle inlet portion 16*b*, or may be arranged with a small distance from the nozzle inlet portion 16*b*.

According to the FIG. 4 embodiment, the nozzle inlet portion 16*b* is arranged with an angle with respect to a main extension plane of said dishwasher spray arm 6. According to some embodiments, the nozzle inlet portion 16*b* comprises a smooth transitional area, which together with the guide vanes 14 guides the washing liquid towards the opening 9 with a reduced rotating motion of the washing liquid. As illustrated in FIG. 4, the nozzle inlet portion 16*b* may be shaped with a double curvature. At least a part of the nozzle inlet portion 16*b* may then be arranged with an angle with respect to a main extension plane of said dishwasher spray arm 6.

The nozzle outlet portion 16*a* may be arranged perpendicular or non-perpendicular to the main extension plane of the dishwasher spray arm 6. In FIG. 4, the nozzle outlet portion is arranged to dispense the washing liquid with an angle relatively the main extension plane of the dishwasher spray arm 6. The angle relatively the main extension plane may be e.g. 10-90 degrees. Different nozzles may be arranged to dispense the washing liquid in different directions, such that the dispensed washing liquid may wash and/or rinse dish placed in any part of the dish racks.

According to some embodiments, only some openings in the dishwasher spray arm 6 are provided with guide vanes. Some other openings may then be arranged without any guide vanes in the vicinity of the openings.

Although the aspects have been described with reference to different embodiments, many different alterations, modifications and the like will become apparent for those skilled in the art.

The invention claimed is:

1. A dishwasher comprising a washing chamber and at least one dishwasher spray arm, said at least one dishwasher spray arm comprising:

a washing liquid intake, an inner volume, at least one opening arranged to dispense washing liquid from said inner volume to said washing chamber, wherein said dishwasher spray arm comprises one or more guide vanes in a vicinity of said at least one opening in a flow channel defined by said inner volume, said one or more guide vanes being arranged to reduce a rotating movement of washing liquid dispensed via said at least one opening relative to a rotating movement of washing liquid dispensed via said at least one opening without guide vanes, and wherein said one or more guide vanes extend in a substantially radial direction from said at least one opening.

2. The dishwasher spray arm according to claim 1, wherein two or more guide vanes extend in a substantially radial direction from said at least one opening.

3. The dishwasher spray arm according to claim 1, wherein 3-6 guide vanes extend in a substantially radial direction from said at least one opening.

4. The dishwasher spray arm according to claim 3, wherein the 3-6 guide vanes extending in a substantially radial direction from said at least one opening are equally spaced about the at least one opening.

5. The dishwasher spray arm according to claim 1, wherein said at least one opening is arranged on a first side of said dishwasher spray arm and in that said one or more guide vanes are arranged on an inner surface portion of said first side of said dishwasher spray arm.

6. The dishwasher spray arm according to claim 1, wherein said at least one opening is shaped as a nozzle.

7. The dishwasher spray arm according to claim 6, wherein said at least one nozzle comprises a nozzle inlet portion and a nozzle outlet portion.

8. The dishwasher spray arm according to claim 7, wherein said nozzle inlet portion is arranged with an angle with respect to a main extension plane of said dishwasher spray arm.

9. The dishwasher spray arm according to claim 1, wherein said at least one opening has a diameter of least 3.5 millimeters.

10. The dishwasher spray arm according to claim 1, wherein said dishwasher spray arm is arranged to rotate when washing liquid is dispensed via said at least one opening.

11. The dishwasher spray arm according to claim 1, wherein said one or more guide vanes comprises at least two guide vanes, and wherein said one or more guide vanes extend in a substantially radial direction from said at least one opening in at least two, substantially opposite directions.

12. The dishwasher spray arm according to claim 1, wherein said wherein said one or more guide vanes direct washing liquid to the at least one opening.

13. The dishwasher spray arm according to claim 1, wherein said one or more guide vanes redirects rotating movement of washing fluid around said at least one opening to substantially linear movement of washing fluid toward said at least one opening.

* * * * *